US010723127B2

(12) United States Patent
Ishida et al.

(10) Patent No.: US 10,723,127 B2
(45) Date of Patent: Jul. 28, 2020

(54) LIQUID EJECTION HEAD AND RECORDING APPARATUS

(71) Applicant: CANON KABUSHIKI KAISHA, Tokyo (JP)

(72) Inventors: Koichi Ishida, Tokyo (JP); Shuzo Iwanaga, Kawasaki (JP); Shintaro Kasai, Yokohama (JP); Yoshiyuki Nakagawa, Kawasaki (JP); Akiko Hammura, Tokyo (JP); Takatsugu Moriya, Tokyo (JP); Tomohiro Sato, Tokyo (JP); Tatsuya Yamada, Kawasaki (JP); Tomoki Ishiwata, Kawasaki (JP); Ayako Iwasaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/372,044

(22) Filed: Apr. 1, 2019

(65) Prior Publication Data

US 2019/0308413 A1 Oct. 10, 2019

(30) Foreign Application Priority Data

Apr. 6, 2018 (JP) ..... 2018-073920

(51) Int. Cl.
*B41J 2/14* (2006.01)
*B41J 2/05* (2006.01)
(Continued)

(52) U.S. Cl.
CPC ..... *B41J 2/14* (2013.01); *B41J 2/04501* (2013.01); *B41J 2/05* (2013.01); *B41J 2/155* (2013.01);
(Continued)

(58) Field of Classification Search
CPC ... B41J 2/01; B41J 2/04501; B41J 2/05; B41J 2/14; B41J 2/1404; B41J 2/155;
(Continued)

(56) References Cited

U.S. PATENT DOCUMENTS

2004/0185693 A1* 9/2004 Yamaguchi ..... B41J 2/04543 439/79
2005/0134617 A1* 6/2005 Yamaguchi ..... B41J 2/155 347/5
(Continued)

FOREIGN PATENT DOCUMENTS

JP 3907685 B2 4/2007

*Primary Examiner* — Anh T Vo
(74) *Attorney, Agent, or Firm* — Canon U.S.A., Inc. IP Division

(57) ABSTRACT

A liquid ejection head including first and second recording element substrates adjacent in a direction intersecting a relative movement direction include ejection opening rows that include ejection openings arranged in the intersecting direction. A straight line connecting the ejection openings in end portions on a second recording element substrate side in the first recording element substrate and a straight line connecting the ejection openings in end portions on a first recording element substrate side in the second recording element substrate are inclined towards a middle area side of the first recording element substrate, and arrangement intervals of the ejection openings in an end portion area on the second recording element substrate side of a first ejection opening row is larger than arrangement intervals of the ejection openings in an end portion area on the first recording element substrate side of a second ejection opening row.

16 Claims, 9 Drawing Sheets

(51) Int. Cl.
*B41J 2/045* (2006.01)
*B41J 2/155* (2006.01)

(52) U.S. Cl.
CPC .. *B41J 2002/14475* (2013.01); *B41J 2202/19* (2013.01); *B41J 2202/20* (2013.01); *B41J 2202/21* (2013.01)

(58) Field of Classification Search
CPC ..... B41J 2002/14475; B41J 2202/20; B41J 2202/21; B41J 2202/19
See application file for complete search history.

(56) References Cited

U.S. PATENT DOCUMENTS

2005/0140722 A1* 6/2005 Shibata ..... B41J 2/15 347/40
2008/0252673 A1* 10/2008 Wada ..... B41J 2/04505 347/12
2012/0050377 A1* 3/2012 Ueshima ..... B41J 2/04501 347/19

* cited by examiner

LIQUID EJECTION HEAD AND RECORDING APPARATUS

BACKGROUND OF THE DISCLOSURE

Field of the Disclosure

The present disclosure relates to a liquid ejection head and a recording apparatus that eject liquid such as ink on a printed medium to perform recording.

Description of the Related Art

Ink jet recording apparatuses which eject droplets with a liquid ejection head to perform recording are widely used, Until droplets ejected from ejection openings of a liquid ejection head land on a printed medium, the air having viscosity situated around the flying droplets is dragged by the movement of the droplets and is moved as well. With the above, an area between an ejection opening surface provided with the ejection openings and the printed medium tends to become lower in pressure than the surroundings thereof, and the surrounding air flows into the above pressure decreased area. It is known that as a result of the above, the droplets ejected particularly from ejection openings, among the ejection openings included in the ejection opening row, positioned at both ends of the ejection openings in an arrangement direction of the ejection openings are drawn to a middle side in an ejection openings arrangement direction; accordingly, the droplets do not land on the predetermined position in the printed medium.

With respect to the deviation in the landing position caused by such a flow of air generated by ejection of the droplets (hereinafter referred to as an autogenous airflow), Japanese Patent No. 3907685 describes a method in which arrangement intervals of the ejection openings positioned at both ends in the arrangement direction of the ejection openings are set larger than those on the middle side in the arrangement direction. It is stated that with the above, the positions of the droplets that land on the printed medium can be corrected to the desired positions and a high quality printed image can be obtained.

In recent years, ink jet recording apparatuses have been used not only for household printing, but also for business printing such as commercial printing and retail photo printing, and the usage of ink jet recording apparatus is increasing. Liquid ejection heads used in such business printing are required to have higher recording performance in speed and in quality. As an example of satisfying such a requirement, recording of printed mediums has been performed while increasing the speed of the relative movement between the recorded medium and the liquid ejection head (hereinafter, merely referred to as relative movement).

As the speed of the relative movement is increased, the influence of an airflow flowing between an ejection opening surface of the liquid ejection head and the printed medium (hereinafter, merely referred to as an inflowing airflow) becomes larger. It is difficult to suppress such an influence exerted by the inflowing airflow with the method described in Japanese Patent No, 3907685.

SUMMARY OF THE INVENTION

The present disclosure provides a liquid ejection head capable of reducing deviation in a landing position of a droplet caused by an inflowing airflow, while achieving high speed recording.

An aspect of the present disclosure is a liquid ejection head including first and second recording element substrates that include a plurality of ejection opening rows in which ejection openings that eject liquid on a printed medium are arranged in a direction intersecting a relative movement direction of the printed medium, the plurality of ejection opening rows being juxtaposed in the relative movement direction, wherein the first and second recording element substrates are disposed adjacent to each other in a direction intersecting the relative movement direction, wherein a straight line connecting the ejection openings in end portions on a second recording element substrate side of the plurality of ejection opening rows of the first recording element substrate and a straight line connecting the ejection openings in end portions on a first recording element substrate side of the plurality of ejection opening rows of the second recording element substrate are, when viewed from an upstream side towards a downstream side in the relative movement direction, inclined with respect to the relative movement direction towards a middle area side of the ejection opening rows of the first recording element substrate, and wherein in the relative movement direction of the printed medium, when viewed from the liquid ejection head towards the printed medium, arrangement intervals of the ejection openings in an end portion area on the second recording element substrate side of a first ejection opening row, among the plurality of ejection opening rows of the first recording element substrate, disposed on a most upstream side is larger than arrangement intervals of the ejection openings in an end portion area on the first recording element substrate side of a second ejection opening row, among the plurality of ejection opening rows of the second recording element substrate, disposed on the most upstream side.

Furthermore, in a recording apparatus including a liquid ejection head that ejects liquid on a printed medium, and a conveying member that conveys the printed medium to the liquid ejection head. The liquid ejection head includes first and second recording element substrates that include a plurality of ejection opening rows in which ejection openings that eject liquid are arranged in a direction intersecting a relative movement direction of the printed medium, the plurality of ejection opening rows being juxtaposed in the relative movement direction, wherein the first and second recording element substrates are disposed adjacent to each other in a direction intersecting the relative movement direction. A straight line connecting the ejection openings in end portions on a second recording element substrate side of the plurality of ejection opening rows of the first recording element substrate and a straight line connecting the ejection openings in end portions on a first recording element substrate side of the plurality of ejection opening rows of the second recording element substrate are, when viewed from an upstream side towards a downstream side in the relative movement direction, inclined relative to the relative movement direction towards a middle area side of the ejection opening rows of the first recording element substrate. In the relative movement direction of the printed medium, when viewed from the liquid ejection head towards the printed medium, arrangement intervals of the ejection openings in an end portion area on the second recording element substrate side of a first ejection opening row, among the plurality of ejection opening rows of the first recording element substrate, disposed on a most upstream side is larger than arrangement intervals of the ejection openings in an end portion area on the first recording element substrate side of a second ejection opening row, among the plurality of ejection opening rows of the second recording element substrate, disposed on the most upstream side.

Further features and aspects of the disclosure will become apparent from the following description of example embodiments with reference to the attached drawings.

DESCRIPTION OF THE EMBODIMENTS

Hereinafter, example embodiments of a liquid ejection head according to the present disclosure will be described with reference to the drawings.

Note that the liquid ejection head of the present disclosure that ejects liquid such as ink and a recording apparatus equipped with the liquid ejection head can be applied to devices such as a printer, a copier, a facsimile including a communication system, and a word processor including a printer unit. Furthermore, the liquid ejection head and the recording apparatus can also be used in industrial recording apparatuses that combine various kinds of processing apparatus in a multiple manner. The liquid ejection head and the recording apparatus can also be used, for example, for fabricating biochips, for printing electronic circuits, for fabricating semiconductor substrates, and in 3D printing.

First Example Embodiment

Description of Recording Apparatus

Figure 1:
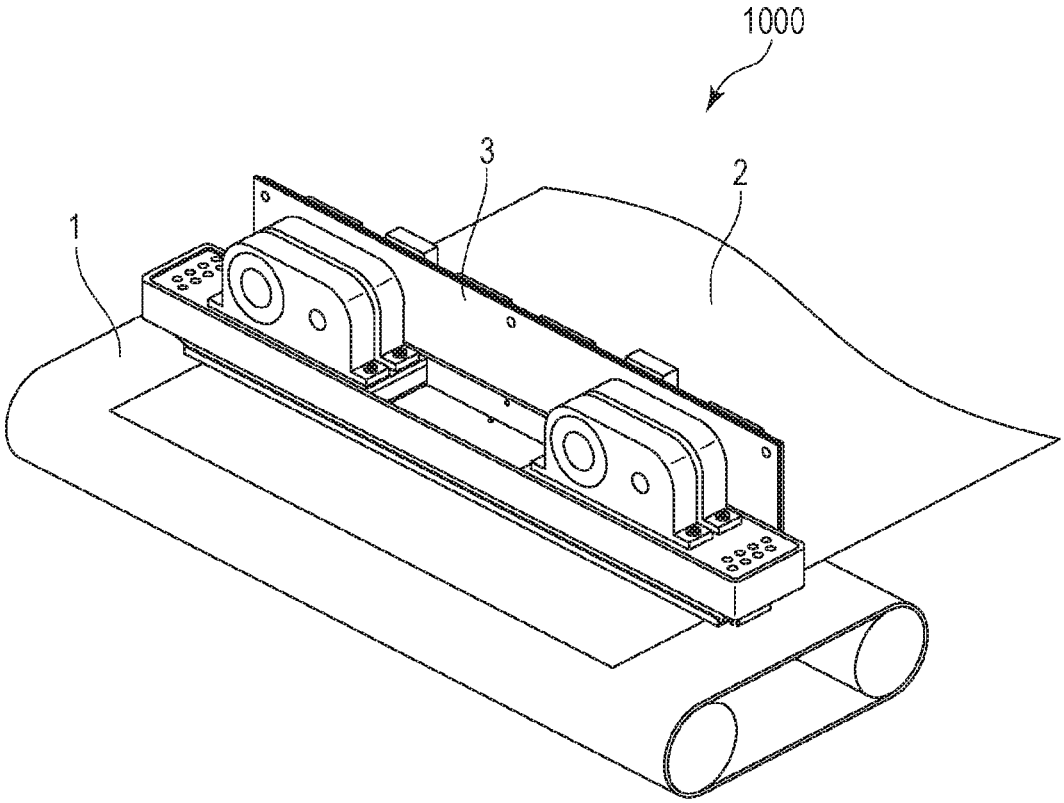
FIG. 1 is a perspective of an example recording apparatus including a liquid ejection head.

Referring to FIG. 1, a configuration of a recording apparatus according to a first example embodiment will be described. FIG. 1 illustrates a recording apparatus 1000 equipped with a liquid ejection head 3, which ejects liquid, according to the example embodiment. The recording apparatus 1000 includes a conveying unit 1 that conveys a printed medium 2 such as paper, and a page wide type liquid ejection head 3 disposed substantially orthogonal to a conveyance direction of the printed medium 2, The recording apparatus 1000 is a page wide type recording apparatus that performs continuous recording in one pass while conveying the printed medium 2 continuously or intermittently.

Furthermore, other than the above, the recording apparatus 1000 includes an ink tank (not shown) that contains ink, a liquid supply passage (not shown) that supplies the ink from the ink tank to the liquid ejection head 3, an electric control unit (not shown) that transmits power and an ejection control signal to the liquid ejection head 3, and the like. In the present example embodiment, the conveyance speed of printed medium 2 is 6 ips.

Description of Liquid Ejection Head

Figure 2A:
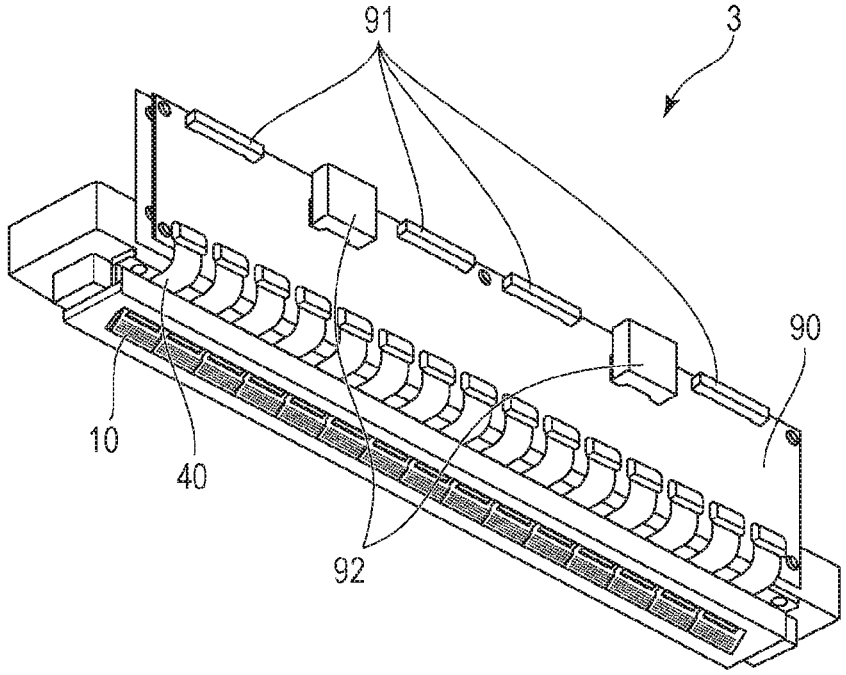
FIG. 2A is a perspective view of the liquid ejection head according to a first example embodiment viewed from a recording element substrate side.
Figure 2B:
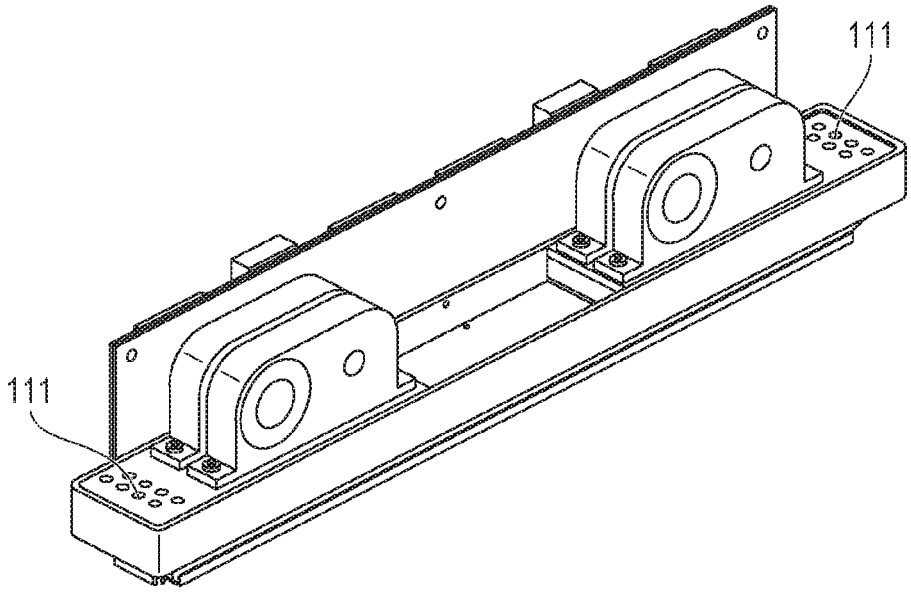
FIG. 2B is a perspective view of the liquid ejection head viewed from a liquid connection portion side.

Referring to FIGS. 2A and 2B, a configuration of the liquid ejection head 3 according to the first example embodiment will be described. FIGS. 2A and 2B are perspective views of the liquid ejection head 3 according to the present example embodiment. The liquid ejection head 3 is a page wide type liquid ejection head in which 15 recording element substrates 10 capable of ejecting the ink of four colors C, M, Y, and K are arranged in a linear manner (disposed inline). The liquid ejection head 3 is detachable from the recording apparatus 1000.

As illustrated in FIG. 2A, the liquid ejection head 3 includes the recording element substrates 10, flexible wiring substrates 40, and an electric wiring board 90. Signal input terminals 91 and power supply terminals 92 are provided in the electric wiring board 90. The signal input terminals 91 and the power supply terminals 92 are electrically connected to the electric control unit (not shown) provided in the recording apparatus 1000, and supply the ejection drive signal and the electric power necessary for ejection to the recording element substrates 10, The number of signal input terminals 91 and the number of power supply terminals 92 can be small compared to the number of recording element substrates 10 owing to an electric circuit in which wiring provided in the electric wiring board 90 is integrated. With the above, the number of electric connection portions needed to be dismounted can be small when the liquid ejection head 3 is installed in the printer 1000 or when the liquid ejection head is replaced.

As illustrated in FIG. 2B, liquid connection portions 111 provided in both end portions of the liquid ejection head 3 are connected to a liquid supply system (not shown provided in the recording apparatus 1000. With the above, a configuration allowing circulation is formed, in which the ink of four colors, namely, C, M, Y, and K are supplied from the liquid supply system (not shown) of the recording apparatus 1000 to the liquid ejection head 3 and is collected into a supply system of the recording apparatus 1000 after passing through pressure chambers 23 (FIG. 3B) inside the recording element substrates 10.

Description of Example Recording Element Substrate

Figure 3A:
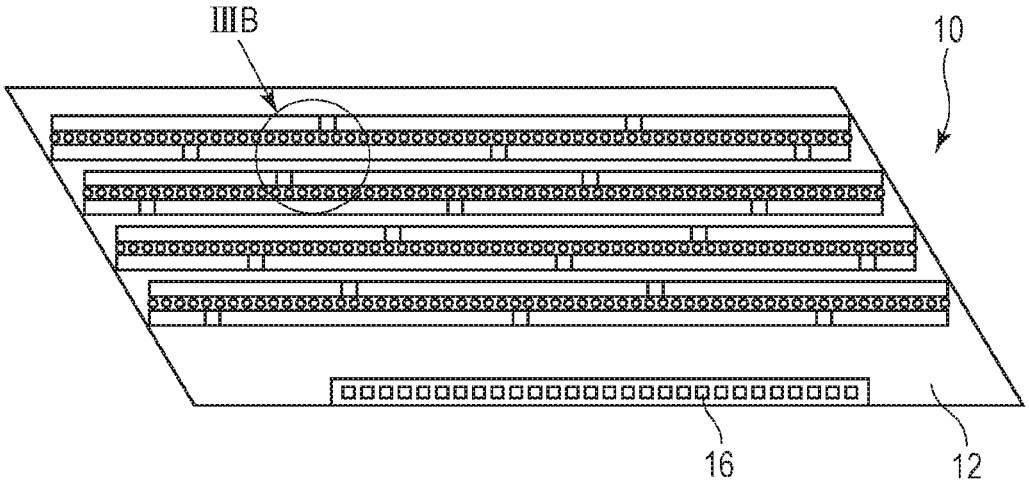
FIG. 3A is a schematic view illustrating the recording element substrate of the liquid ejection head according to the first example embodiment.

A configuration of the recording element substrate 10 according to the present example embodiment will be described with reference to FIGS. 3A and 3B. FIG. 3A is a plan view of a surface of the recording element substrate 10 on the side in which ejection openings 13 are formed, and FIG. 3B is an enlarged view of an area indicated by IIIB in FIG. 3A.

As illustrated in FIG. 3A, an outer shape of the recording element substrate 10 in the present example embodiment is substantially parallelogram-shaped, and four ejection opening rows corresponding to the colors of the ink, that is, CMYK, are formed. As illustrated in FIG. 2A, the page wide type liquid ejection head is configured by disposing a plurality of recording element substrates 10 inline in a straight line in a longitudinal direction of the liquid ejection head 3 with short sides of the recording element substrates 10 adjacent to each other. The recording element substrates 10 are each formed of a substrate (not shown) in which energy generating elements 15, supply ports 17*a*, collection ports 17*b*, and the like described below are formed and an ejection openings forming member 12 in which ejection openings 13 are formed are layered on each other. For example, the substrate is formed of Si and the ejection openings forming member 12 is formed of a resin member.

Figure 3B:
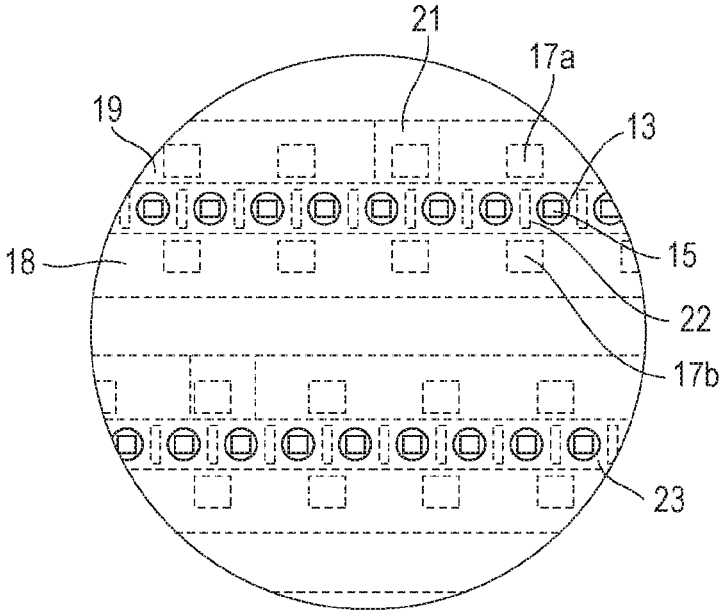
FIG. 3B is an enlarged view of the area IIIB in FIG. 3A.

The ejection openings 13 illustrated in FIG. 3B are openings configured to eject droplets on the printed medium 2. In the present example embodiment, in order to obtain a printed image of high quality, a dimension of the opening of each ejection opening and the like are set so that a droplet having a minute volume of 5.7 picoliters is ejected by a single drive of the liquid ejection head. The energy generating elements 15 play a role of heating the liquid by thermal energy and film boiling the liquid, and eject droplets from the ejection openings 13 by foaming pressure of the film boiling. The energy generating elements 15 are disposed at positions corresponding to the ejection openings 13. The pressure chambers 23 are spaces that include the energy generating elements 15 and that store the liquid upon which the foaming pressure created by the energy generating elements 15 acts. The partition walls 22 partition the pressure chambers 23 from each other.

The energy generating elements 15 are electrically connected to a terminal 16 of the recording element substrate 10 by electric wiring (not shown) provided in the recording element substrate 10. Each energy generating element 15 generates heat based on a pulse signal input from a control circuit of the recording apparatus 1000 sequentially through the electric wiring board 90, the flexible wiring substrate 40, and the terminal 16. Note that the energy generating elements 15 are not limited to heating elements, and various types such as piezo elements and the like can be used.

The liquid supplied from the recording apparatus 1000 is supplied into the liquid ejection head 3 through the liquid connection portions 111, and is supplied to openings 21 of each recording element substrate 10 through a common supply passage (not shown). The liquid supplied through the openings 21 to the recording element substrates 10 is ejected from the ejection openings 13 after being supplied into the pressure chambers through the liquid supply passages 18 and the supply ports 17*a*. The liquid that has not been ejected flows out from the pressure chambers to the outside of the recording element substrates 10 through the collection ports 17*b* and the liquid collection passages 19, and after passing through a common collection passage (not shown), the liquid is collected to a portion external to the liquid ejection head 3 through the liquid connection portions 111. The liquid ejection head 3 in the present example embodiment is, in the above manner, configured so that the liquid in the pressure chambers can be circulated to a portion external to the pressure chambers 23. Note that in the present example embodiment, the gap between the printed medium 2 and an ejection opening surface of each recording element substrate 10 where the ejection openings are formed is 1.5 mm.

Description of Example Ejection Opening Rows

Figure 4:
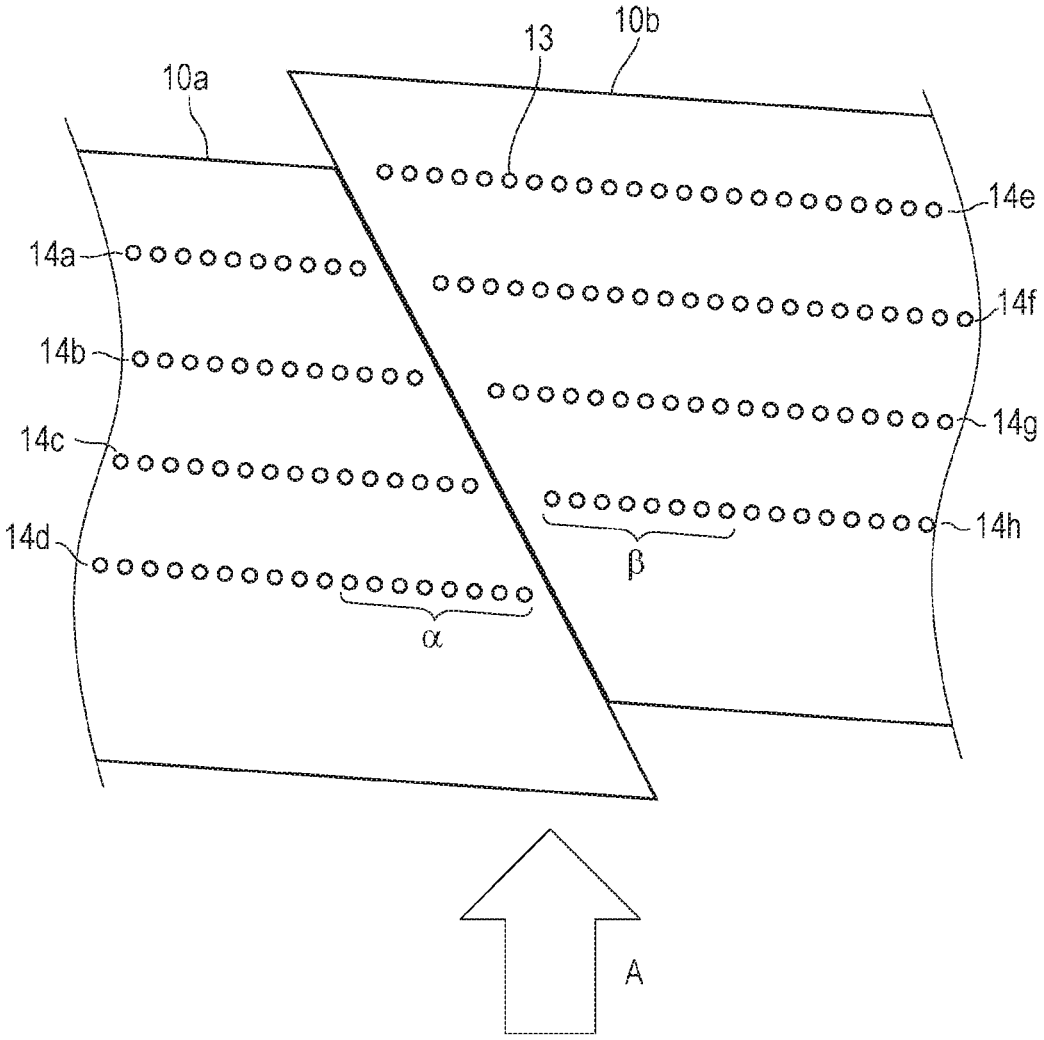
FIG. 4 is an enlarged view of adjacent portions in recording element substrates adjacent to each other.

FIG. 4 is a diagram illustrating an adjacent portion of two adjacent recording element substrates 10, among the plurality of recording element substrates 10, in a partially enlarged manner. An arrow A in the drawing illustrates a direction of the relative movement of the printed medium (hereinafter, merely referred to as a relative movement direction) when viewing the printed medium 2 from the liquid ejection head 3 during an operation of ejecting the liquid from the liquid ejection head.

As illustrated in FIG. 4, in the recording element substrates 10, a plurality of ejection opening rows (14*a* to 14*h*) are formed side by side in the relative movement direction. Furthermore, the ejection opening rows (14*a* to 14*h*) are each formed by arranging a plurality of ejection openings 13 in a direction intersecting the relative movement direction.

Ejection opening rows (14*a* to 14*d*) including the first ejection opening row 14*d* positioned on the most upstream side in the relative movement direction are formed in the recording element substrate 10*a* (hereinafter referred to as a first recording element substrate 10*a*) on the left side in FIG. 4. Ejection opening rows (14*e* to 14*h*) including the second ejection opening row 14*h* positioned on the most upstream side are formed in the recording element substrate 10*b* (hereinafter referred to as a second recording element substrate 10*b*) on the right side in FIG. 4.

Regarding the ejection opening rows that eject the corresponding type (color) of ink, the ejection opening row of the recording element substrate 10*a* is positioned on the upstream side, and the ejection opening row of the recording element substrate 10*b* is positioned on the downstream side. Furthermore, as illustrated in FIG. 4, by inclining the adjacent portions of the recording element substrates 10 with respect to the relative movement direction, recording in which streak-like irregularities are reduced can be performed also in the adjacent portions of the recording element substrates. In other words, when viewed from the upstream side towards the downstream side in the relative movement direction, a straight line connecting the ejection openings 13 at end portions of the ejection opening rows (14*a* to 14*d*) on the adjacent side (the right side) in the recording element substrate 10*a* is inclined with respect to the relative movement direction. Similarly, a straight line connecting the ejection openings 13 at end portions of the ejection opening rows (14*e* to 14*h*) on the adjacent side (the left side) in the recording element substrate 10*b* is inclined with respect to the relative movement direction towards the same side as that of the recording element substrate 10*a*.

The following can be described as a characteristic configuration of the present example embodiment, Arrangement intervals of the ejection openings in end portion area on the second recording element substrate 10*b* side of the ejection opening row 14*d* on the most upstream side of the first recording element substrate 10*a* in the relative movement direction is larger than arrangement intervals of the ejection openings in end portion area on the first recording element substrate side of the ejection opening row 14*h* on the most upstream side of the second recording element substrate.

Furthermore, not limited to the comparison between the ejection opening rows 14*d* and 14*h*, arrangement intervals of the ejection openings in end portion areas of the ejection opening rows (14*a* to 14*d*) of the first recording element substrate 10*a* on the second recording element substrate 10*b* side may be larger than the ejection opening rows (14*e* to 14*h*) of the second recording element substrate 10*b*.

Note that in each of the ejection opening rows (14*a* to 14*d*) of the first recording element substrate 10*a*, the arrangement intervals of the ejection openings in the end portion area are set larger than arrangement intervals of the ejection openings in the middle area.

Figure 5A:
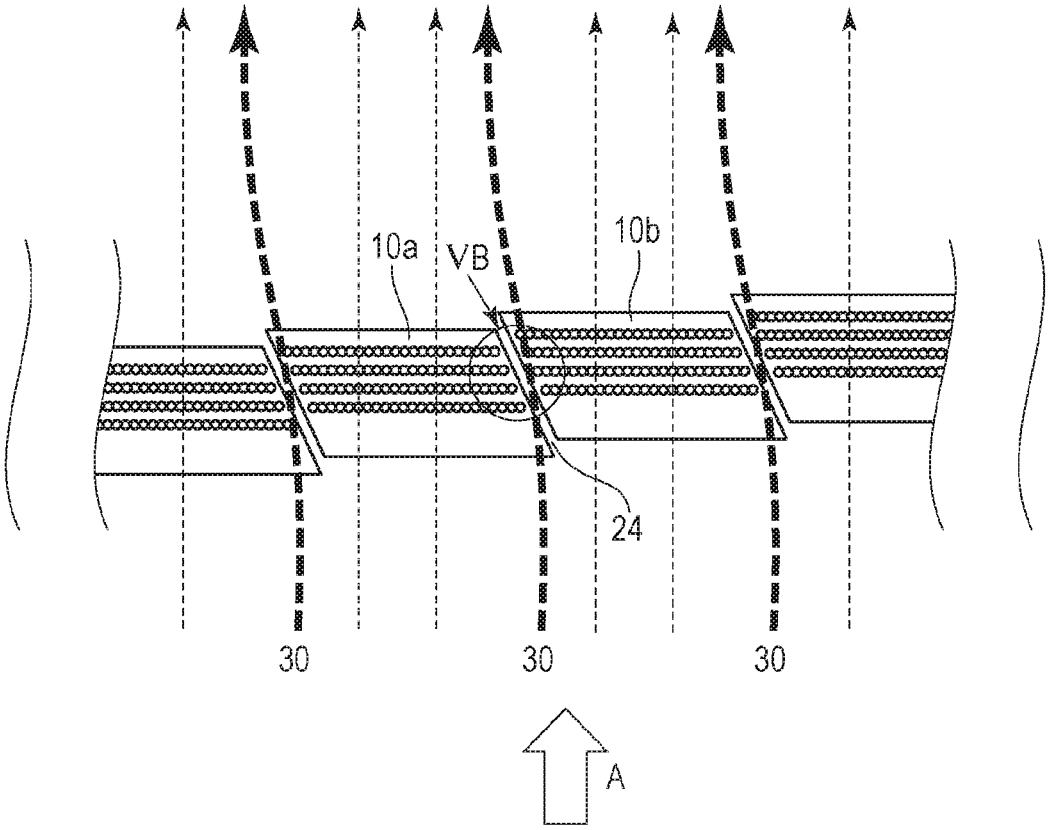
FIG. 5A is a diagram schematically illustrating inflowing airflows in the adjacent portions of the recording element substrates.
Figure 5B:
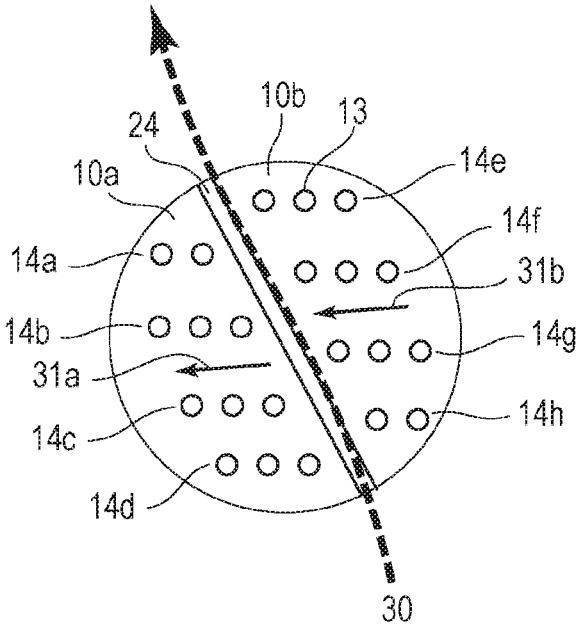
FIG. 5B is an enlarged view of area VB illustrated in FIG. 5A.

In the present example embodiment, the arrangement intervals of the ejection openings in the middle area (not shown) in the arrangement direction is 42.3 μm. (600 dpi). Meanwhile, the arrangement intervals of ejection openings α in the end portion area of the ejection opening row 14*d* positioned on the most upstream side in the relative movement direction is 43.3 μm, and the arrangement intervals of ejection openings β in the end portion area of the ejection opening row 14*h* positioned on the downstream side with respect to the ejection opening row 14*d* is 42.8 μm. Details and effects of such configuration will be described below Description of Effects Hereinafter, an effect of the present example embodiment will be described with reference to FIGS. 5A and 5B. FIG. 5A illustrates, with arrows, directions in which inflowing airflows 30 flow in a state in which the ink is ejected from a plurality of ejection openings and recording is performed while the liquid ejection head 3 and the printed medium 2 are moved with respect to each other, FIG. 5B is a schematic view in which area VB in FIG. 5A has been enlarged.

Owing to the relative movement, the inflowing airflows 30 occur between the ejection opening surface in which the ejection openings 13 of the liquid ejection head 3 are formed and the printed medium 2. Note that in a state in which the ink is ejected from the plurality of ejection openings 13, a so-called air curtain is formed in a direction from the ejection openings to the printed medium due to the flying droplets; accordingly, it is difficult for the inflowing airflows 30 to pass through the area of the ejection opening rows 14. Accordingly, a portion of each inflowing airflow 30 flows to the end portion side of the ejection opening rows 14, and a flow that bypasses the ejection opening rows 14 occurs. In other words, as illustrated in FIG. 5A, the inflowing airflows 30 actively pass through areas 24 between the ejection opening rows, which are areas where the air curtain is relatively weak. As described above, the ejection openings at the end portions of the ejection opening rows and in the adjacent portions of the recording element substrates are inclined with respect to the conveyance direction, and the inflowing airflows at the above portions are also inclined with respect to the conveyance direction.

As in the present example embodiment, in a one pass type recording apparatus that performs recording on the printed medium with a single relative movement, the directions of the inflowing airflows 30 are the same; accordingly, the inflowing airflows 30 inclined in the same direction are generated in the areas 24. Due to the above inclined inflowing airflows 30, the inflowing airflows 30 each include a component 31*a* oriented towards the middle area in the arrangement direction of the ejection openings in each of the ejection opening rows (14*a* to 14*d*) of the recording element substrate 10*a* on the upstream side in the relative movement direction illustrated in FIG. 5B. Meanwhile, the inflowing airflows 30 each include a component 31*b* oriented towards the end portion in the arrangement direction in the ejection opening rows (14*e* to 14*h*) of the recording element substrate 10*b* on the downstream side in the relative movement direction.

As described above, in the adjacent portions of the ejection opening rows (14*a* to 14*d*) on the upstream side and the ejection opening rows (14*e* to 14*h*) on the downstream side, since the ejected droplets are influenced in different directions by the inflowing airflows, the landing positions of the ejected droplets are influenced as well. Specifically the droplets ejected from the ejection openings on the end portion side of the ejection opening rows (14*a* to 14*d*) land at positions deviated towards the middle side (in the left direction) with respect to predetermined landing positions due to the influence of the components 31*a*. Similarly, the droplets ejected from the ejection openings on the end portion side of the ejection opening rows (14*e* to 14*h*) land at positions deviated towards the end portion side (in the left direction) with respect to predetermined landing positions due to the influence of the components 31*b*. In order to correct the deviation in the landing positions of the droplets, the arrangement intervals of the ejection openings on the end portion side of the ejection opening rows (14*a* to 14*d*) are set wide, and the ejection openings of the ejection openings on the end portion side of the ejection opening rows (14*e* to 14*h*) are set narrow. In other words, the arrangement intervals of the ejection openings at the end portions of the ejection opening rows (14*a* to 14*d*) are set wider than the arrangement intervals of the ejection openings at the end portions of the ejection opening rows (14*e* to 14*h*).

Since the influence of such inflowing airflows acts particularly greatly on the ejection opening rows on the most upstream side in each of the recording element substrates 10, desirably, at least the ejection opening rows 14*d* and 14*h* on the most upstream side in the recording element substrates 10*a* and 10*b* are configured in the following manner. The arrangement intervals of the ejection openings in the end portion area on the second recording element substrate 10*b* side of the ejection opening row 14*d* is set larger than the arrangement intervals of the ejection openings in the end portion area on the first recording element substrate 10*a* side of the ejection opening row 14*h*. Depending on the degree of influence of the inflowing airflows 30, the ejection opening rows (14*a* to 14*c*, and 14*e* to 14*a*) other than those on the most upstream side can also adopt the above configuration.

Autogenous Airflow

In addition to the inflowing airflows, autogenous airflows owing to the ejections of the droplets are generated considerably in a space interposed between the ejection opening surface of the liquid ejection head 3 and the printed medium 2. The present example embodiment can be applied in a manner similar to the above even when such autogenous airflows are considered. Description will be given with reference to FIGS. 6A and 6B.

Figure 6A:
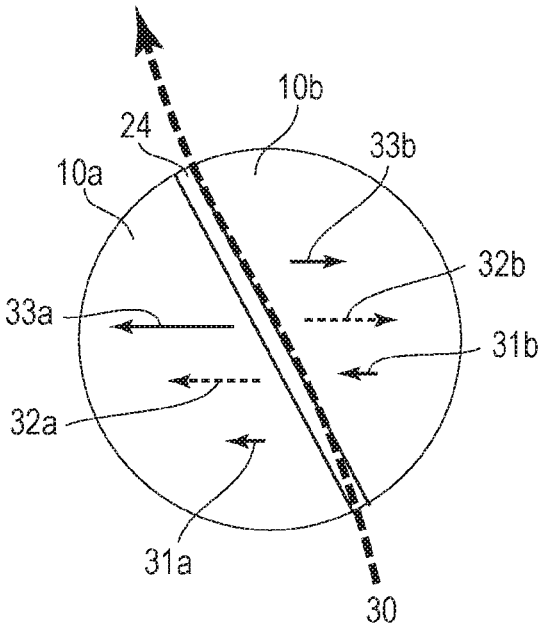
FIG. 6A is a schematic view schematically illustrating autogenous airflows, the inflowing airflows, and composite components of the autogenous airflows and the inflowing airflows when the inflowing airflows are smaller than the autogenous airflows.
Figure 6B:
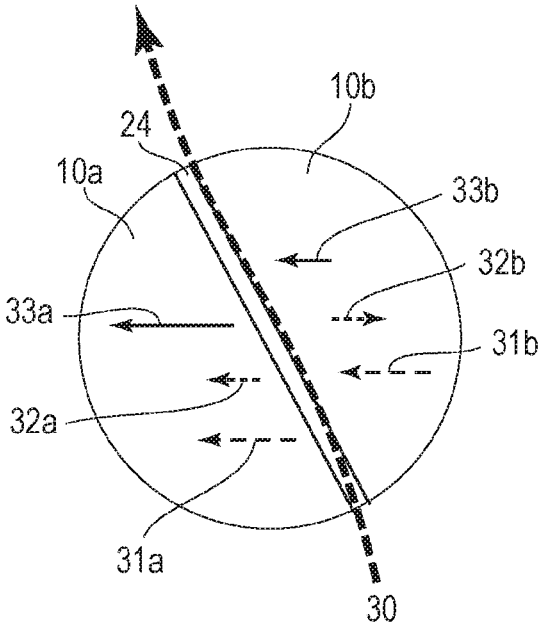
FIG. 6B is a schematic view schematically illustrating the autogenous airflows, the inflowing airflows, and the composite components of the autogenous airflows and the inflowing airflows when the inflowing airflows are larger than the autogenous airflows.

FIGS. 6A and 6B are schematic views of areas VIA and VIB, respectively, in FIG. 5A illustrated in an enlarged manner, and illustrate, in a direction of the ejection opening rows, components of the autogenous airflows, the components of the inflowing airflows, and the composite components of the autogenous airflows and the inflowing airflows, Note that the illustration of the ejection openings 13 are omitted. The component of the inflowing airflow acting on an area adjacent to the ejection openings of the first recording element substrate 10*a* is indicated by an arrow 31*a*, the component of the autogenous airflow by an arrow 32*a*, and the composite component of the inflowing airflow and the autogenous airflow by an arrow 33*a*, Furthermore, the component of the inflowing airflow acting on an area adjacent to the ejection openings of the second recording element substrate 10*b* is indicated by an arrow 31*b*, the component of the autogenous airflow by an arrow 32*b*, and the composite component of the inflowing airflow and the autogenous airflow by an arrow 33*b*.

Since the autogenous airflows attract the surrounding air towards the middle area (not shown) of the ejection opening rows, the droplets ejected from the ejection openings positioned on both end sides in the ejection openings arrangement direction are, in particular, attracted to the middle side in the arrangement direction. As illustrated in FIGS. 6A and 6B, the influence of such autogenous airflows acts on the ejection opening rows of the first recording element substrate 10*a* (32*a*) and, in a similar manner, on the ejection opening rows of the second recording element substrate 10*b* (32*h*) as well in directions towards the middle portion areas of the ejection opening rows.

FIG. 6A illustrates a case in which the autogenous airflow 32*a* is larger than the inflowing airflow 31*a*, and FIG. 6B illustrates a ease in which the inflowing airflow 31*b* is larger than the autogenous airflow 32*b*. As illustrated in FIG. 6A, the composite component 33*b* in the recording element substrate 10*b* is oriented towards the middle side (the right side) and is different from the direction illustrated in FIG. 5B. The composite component 33*a* of the recording element substrate 10*a* is larger than the composite component 33*b*. Accordingly, similar to the configuration described above, desirably, the arrangement intervals of the ejection openings at the end portions of the ejection opening rows (14*a* to 14*d*) are set wider than the arrangement intervals of the ejection openings at the end portions of the ejection opening rows (14*e* to 14*h*).

In FIG. 6B, the composite component 33*a* of the recording element substrate 10*a* and the composite component 33*b* of the recording element substrate 10*b* are both oriented towards the left. Accordingly, similar to the above, it is desirable that in the present configuration as well, the arrangement intervals of the ejection openings at the end portions of the ejection opening rows (14*a* to 14*d*) are set wider than the arrangement intervals of the ejection openings at the end portions of the ejection opening rows (14*e* to 14*h*).

Accordingly, the present example embodiment can be applied even when the influence of the autogenous airflows is taken into consideration. In other words, by setting the arrangement intervals of the ejection openings in the end portion area of the first ejection opening row arranged on the most upstream side in the relative movement direction larger than the arrangement intervals of the ejection openings of in the end portion area of the second ejection opening rows, the deviation in the landing positions of the droplets can be reduced.

Other Example Configurations

The deviation in the landing position of the droplet owing to such inflowing airflows becomes significant when a droplet having a minute volume of 10 picoliters or less is ejected in a single driving operation since the inertial mass of the droplet becomes small.

Furthermore, the deviation in the landing position owing to the inflowing airflows in the end portion areas of the ejection opening occurs when the distance between the adjacent ejection opening rows are larger than the distance between the adjacent ejection openings and becomes more significant when the distance between the adjacent ejection opening rows becomes larger. The above is because as the distance between the ejection opening rows increases, more inflowing airflows flow between the printed medium and the liquid ejection head. Accordingly, it is desirable that the distance between adjacent ejection opening rows be as short as possible.

Furthermore, by overlapping the ejection openings in the end portion areas of the ejection opening rows of the adjacent recording element substrates in the relative movement direction, even in a case in which the droplets deviate somewhat from the predetermined positions, the degradation in the recording quality can be made less noticeable.

The influence of the inflowing airflow on the deviation in the landing positions of the droplets becomes more significant when the relative movement speed between the printed medium and the liquid ejection head is 0.4 m/s or more, when the distance between the printed medium and the liquid ejection head is 2 mm or less, and when the array density of the ejection openings of the liquid ejection head is 600 dpi or more. The present example embodiment can be applied more suitably to such cases.

Second Example Embodiment

Regarding Rectangular Recording Element Substrates

Figure 7:
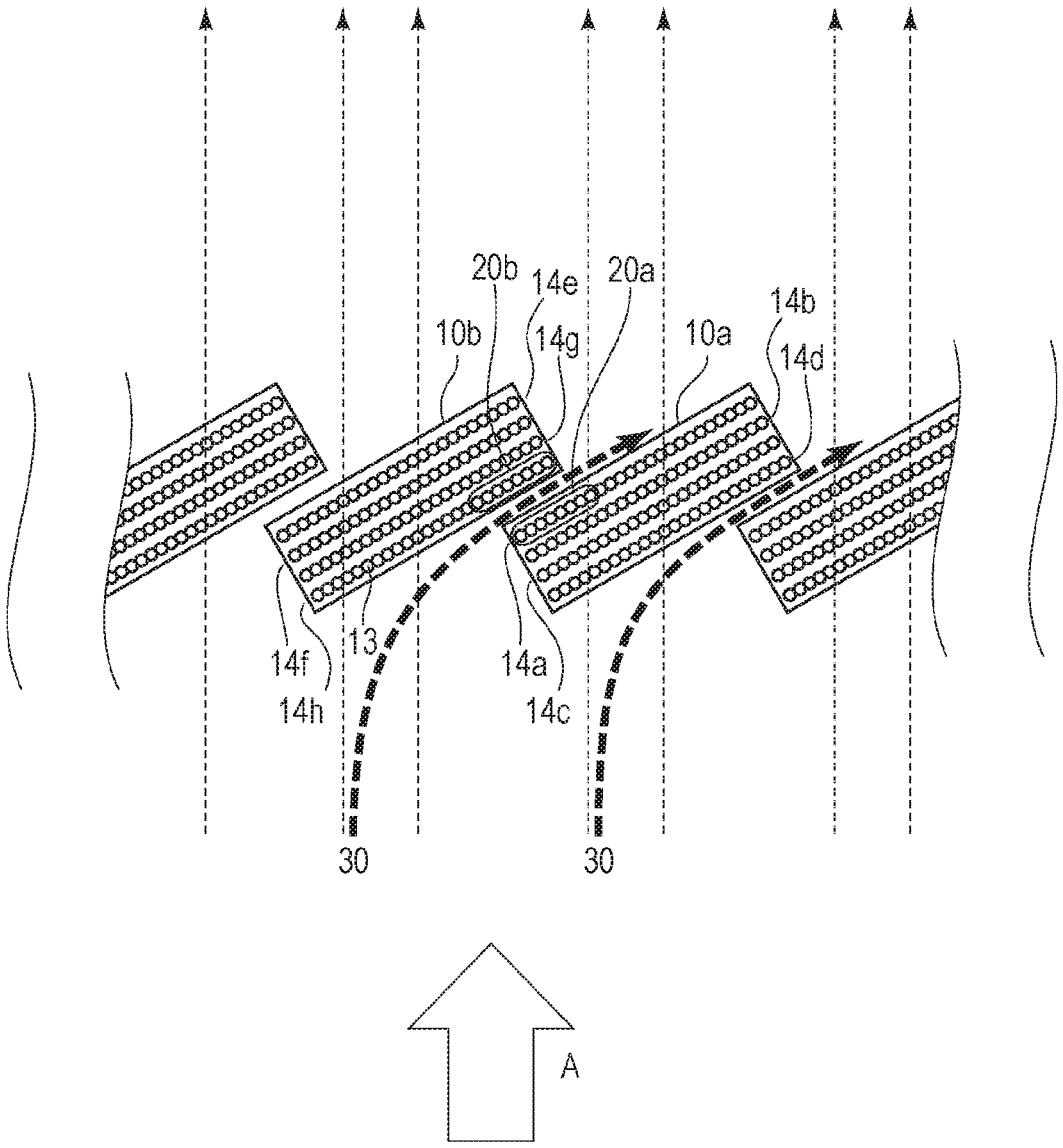
FIG. 7 is a schematic view schematically illustrating the inflowing airflows according to a second example embodiment.

FIG. 7 is a diagram illustrating a configuration in which recording element substrates having a substantially rectangular shape are applied to the present example embodiment. As illustrated in FIG. 7, by disposing the recording element substrates at a certain angle with respect to the conveyance direction and arranging the recording element substrates in a straight line in a direction intersecting the relative movement direction, ejection openings continuing in the width direction of the printed medium can be provided. In other words, in the present example embodiment, the arrangement direction of the ejection openings is inclined with respect to the relative movement direction. Furthermore, a higher density recording can be performed with the present configuration. In the present example embodiment, when viewed from the upstream side towards the downstream side in the relative movement direction, the recording element substrate on the side in which the arrangement direction of the ejection openings is inclined with respect to the relative movement direction A is referred to as the first recording element substrate 10*a* and the other recording element substrate is referred to as the second recording element substrate 10*b*.

As illustrated in FIG. 7, inflowing airflows 30 which flow in an oblique manner with respect to the relative movement direction are generated in the present example embodiment as well. Accordingly, owing to the inflowing airflow 30, force acting in the direction towards the middle portion side of the ejection opening row 14*a* is applied to the droplets ejected from the ejection openings in an end portion area 20*a* on the second recording element substrate 10*b* side of the ejection opening row 14*a* on the most downstream side in the first recording element substrate 10*a*. Meanwhile, force acting in the direction towards the end portion side of the ejection opening row 14*h* on the first recording element substrate 10*a* side is applied to the droplets ejected from the ejection openings in the end portion area 20*b* on the first recording element substrate 10*a* side of the ejection opening row 14*h* on the most upstream side in the second recording element substrate 10*b*. Accordingly, the influence of the inflowing airflow 30 on the droplets can be reduced by having the arrangement intervals of the ejection openings in the end portion area 20*a* of the ejection opening row 14*a* of the first recording element substrate 10*a* set larger than the arrangement intervals of the ejection openings in the end portion area 20*b* of the ejection opening row 14*h* of the second record ng element substrate 10*b*.

Note that in FIG. 7, the recording element substrates that have a rectangular outer shape have been illustrated and the description of the present example embodiment has been given; however, the present example embodiment is not limited to the above shape. In other words, for example, even if the outer shapes of the recording element substrates are each parallelogram-shaped, if the arrangement direction of the ejection openings is inclined with respect to the relative movement direction, the inflowing airflow equivalent to the inflowing airflow 30 described in the present example embodiment is generated, and with the application of the configuration of the present example, the influence of the inflowing airflow can be reduced.

Third Example Embodiment

Regarding Trapezoidal Recording Element Substrates

Figure 8:
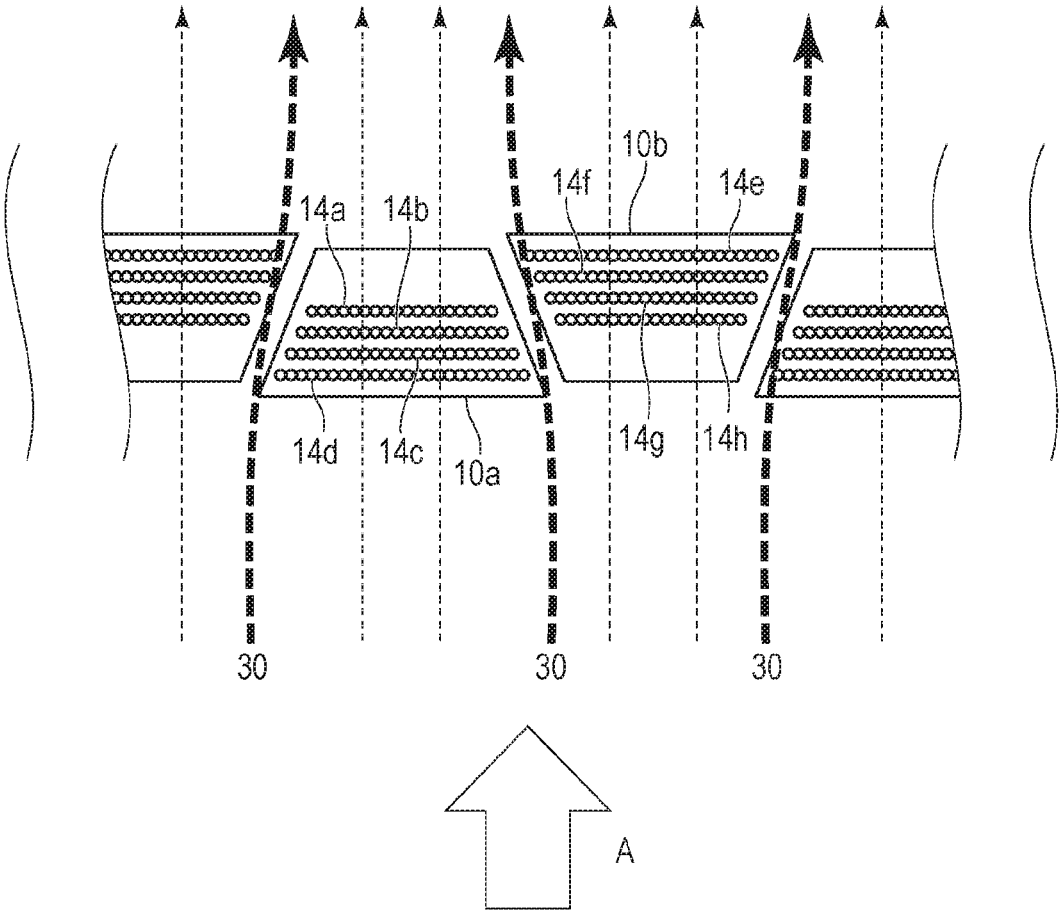
FIG. 8 is a schematic view schematically illustrating the inflowing airflows according to a third example embodiment.

FIG. 8 is a schematic view of a page wide type liquid ejection head in which substantially trapezoidal recording element substrates are arranged in a straight line in the longitudinal direction of the liquid ejection head. The point that a plurality of ejection opening rows are formed parallel to each other in each of the recording element substrates 10 is similar to the example embodiments described above.

The present example embodiment is different from the second example embodiment in that each of the ejection opening rows is arranged in a direction substantially perpendicular to the relative movement direction. As illustrated in FIG. 8, the recording element substrates 10 are arranged in the width direction of the printed medium so that the orientations thereof are alternately inverted. With the above, the ejection openings are continuously arranged in the width direction of the printed medium. Furthermore, an area in which the recording element substrates 10 are disposed in the relative movement direction can be narrower than an area in which the parallelogram-shaped recording element substrates 10, which are recording element substrates 10 of the first example embodiment, are disposed in the relative movement direction.

As illustrated in FIG. 8, in the present example embodiment as well, the inflowing airflows are also inclined with respect to the relative movement direction. Accordingly, the influence of the inflowing airflow can be reduced by setting the arrangement intervals of the ejection openings at both end portions of the ejection opening row of the recording element substrate disposed on the upstream side in the relative movement direction larger than the arrangement intervals of the ejection openings at both end portions of the ejection opening row of the recording element substrate disposed downstream.

Fourth Example Embodiment

Figure 9:
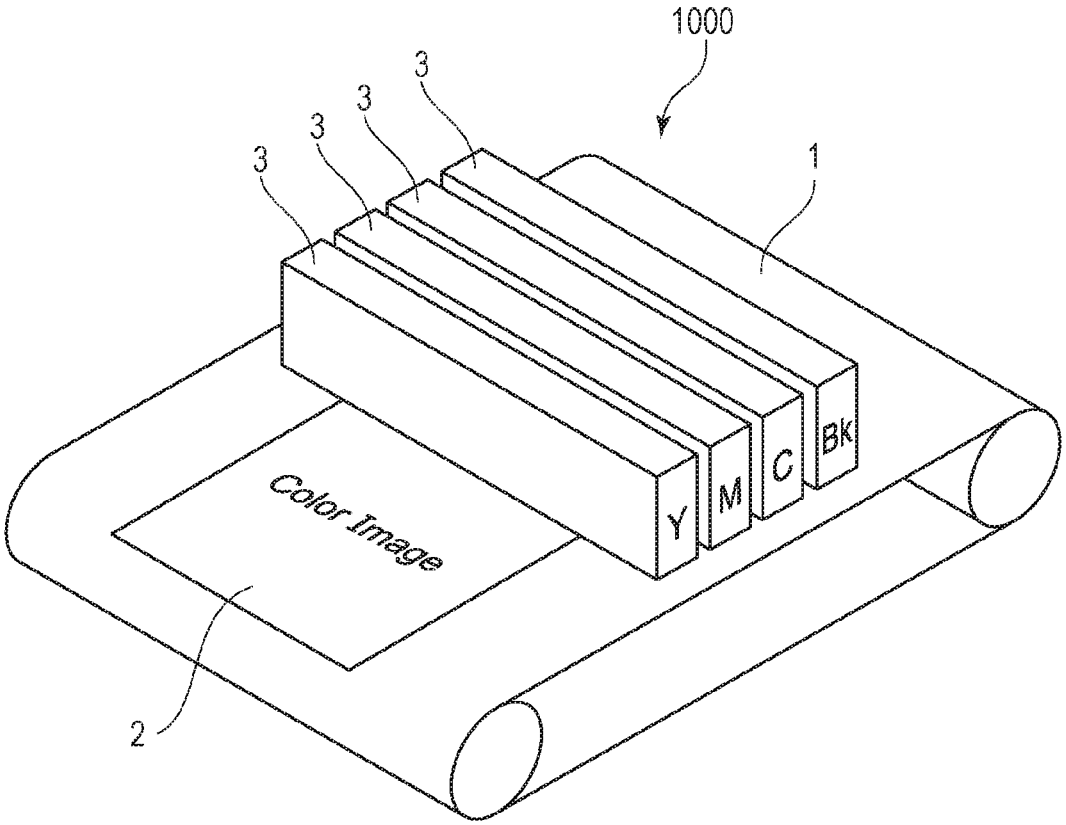
FIG. 9 is a perspective of a recording apparatus including a liquid ejection head according to a fourth example embodiment.

In each of the example embodiments described above, configurations in which ink of plural colors are ejected with a single recording element substrate are illustrated; however, the present example embodiment illustrated in FIG. 9 illustrates a configuration in which a single color is ejected with a single liquid ejection head. In other words, by arranging four liquid ejection heads 3, each for a single color, that is, for the ink of CMYK in a parallel manner, a full-color recording is performed on the printed medium. While in the first example embodiment, the number of ejection opening rows that can be used per color is one; however, in the present example embodiment, the number of ejection opening rows that can be used per color is plural (20 rows herein). Accordingly, extremely fast recording can be performed by performing printing while appropriately allocating the recording data to the plurality of ejection opening rows. Furthermore, even if there are ejection openings in which ink is not ejected, by ejecting, in an interpolating manner, from ejection openings of another row at positions corresponding to the above ejection openings in the conveyance direction of the printed medium, reliability is improved and is suitable for business printing. By applying the present example embodiment to such an ejection head including a plurality of ejection opening rows, each for a single color, on a single recording element substrate, an effect similar to that of the first example embodiment can be obtained.

Note that for the sake of description, the printed medium is conveyed to the liquid ejection head; however, the present disclosure is not limited to the above, and the printed medium and the liquid ejection head may be moved with respect to each other. Note that for the sake of description, the printed medium is conveyed to the liquid ejection head; however, the present disclosure is not limited to the above, and the printed medium and the liquid ejection head may be moved with respect to each other.

In the above description, description was given using the page wide type liquid ejection head, but the present disclosure is not limited to the page wide type liquid ejection head. In other words, the present disclosure can also be applied to a so-called serial-type liquid ejection head which performs recording while reciprocating in the width direction of printed medium. In the serial type liquid ejection head, in a case in which the ejection opening rows are arranged in a direction intersecting the relative movement direction of the printed medium and the liquid ejection head, in other words, in a direction that is substantially orthogonal to a direction in which the liquid ejection head reciprocates with respect to the printed medium, the effect of suppressing the influence of the inflowing airflow on the ejected droplets is large when the configuration of the present disclosure is used.

Additionally, the present disclosure is capable of reducing deviation in the landing position of the droplets caused by the inflowing airflow, and is capable of providing a printed image with high quality at high speed.

While the disclosure has been described with reference to example of embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2018-073920, filed Apr. 6, 2018, which is hereby incorporated by reference herein in its entirety.

What is claimed is:

1. A liquid ejection head comprising:

first and second recording element substrates that include a plurality of ejection opening rows in which ejection openings that eject liquid on a printed medium are arranged in a direction intersecting a relative movement direction of the printed medium, the plurality of ejection opening rows being juxtaposed in the relative movement direction, wherein the first and second recording element substrates are disposed adjacent to each other in a direction intersecting the relative movement direction, wherein a straight line connecting the ejection openings in end portions on a second recording element substrate side of the plurality of ejection opening rows of the first recording element substrate and a straight line connecting the ejection openings in end portions on a first recording element substrate side of the plurality of ejection opening rows of the second recording element substrate are, when viewed from an upstream side towards a downstream side in the relative movement direction, inclined with respect to the relative movement direction towards a middle area side of the ejection opening rows of the first recording element substrate, and wherein in the relative movement direction of the printed medium, when viewed from the liquid ejection head towards the printed medium, arrangement intervals of the ejection openings in an end portion area on the second recording element substrate side of a first ejection opening row, among the plurality of ejection opening rows of the first recording element substrate, disposed on a most upstream side is larger than arrangement intervals of the ejection openings in an end portion area on the first recording element substrate side of a second ejection opening row, among the plurality of ejection opening rows of the second recording element substrate, disposed on the most upstream side.

2. The liquid ejection head according to claim 1, wherein in the relative movement direction, the first ejection opening row is disposed on the upstream side with respect to the second ejection opening row.

3. The liquid ejection head according to claim 1, wherein arrangement intervals of the ejection openings in the end portion area on the second recording element substrate side of each ejection opening row of the first recording element substrate is larger than arrangement intervals of the ejection openings in the end portion area on the first recording element substrate side of each ejection opening row of the second recording element substrate.

4. The liquid ejection head according to claim 1, wherein the arrangement intervals of the ejection openings in the end portion area on the second recording element substrate side of the first ejection opening row is larger than arrangement intervals of the ejection openings in a middle area of the first ejection opening row.

5. The liquid ejection head according to claim 1, wherein the first and second recording element substrates are substantially parallelogram-shaped.

6. The liquid ejection head according to claim 1, wherein the first and second recording element substrates are substantially rectangular.

7. The liquid ejection head according to claim 1, wherein the first and second recording element substrates are substantially trapezoidal.

8. The liquid ejection head according to claim 1, wherein a volume of a single ejection of the liquid ejected from the ejection openings is 10 picoliters or less.

9. The liquid ejection head according to claim 1, wherein a speed of a relative movement in the relative movement direction is 0.4 m/s or more.

10. The liquid ejection head according to claim 1, wherein a gap between an ejection opening surface in which the ejection openings are provided and the printed medium is 2 mm or less.

11. The liquid ejection head according to claim 1, wherein the first and second recording element substrates each eject different types of liquid.

12. The liquid ejection head according to claim 1, wherein arrangement intervals of the ejection openings included in the plurality of ejection opening rows are each 600 dpi or more.

13. The liquid ejection head according to claim 1, wherein a plurality of recording element substrates including the first and second recording element substrates are arranged in a straight line in an area corresponding to a width of the printed medium.

14. The liquid ejection head according to claim 1, further comprising:

an energy generating element that generates energy that ejects liquid; and a pressure chamber including the energy generating element, wherein the liquid in the pressure chamber is circulated to a portion external to the pressure chamber.

15. A liquid ejection head comprising:

rectangular first and second recording element substrates that include a plurality of ejection opening rows in which ejection openings that eject liquid on a printed medium are arranged in a direction intersecting a relative movement direction of the printed medium, the plurality of ejection opening rows being juxtaposed in the relative movement direction, wherein the first and second recording element substrates are disposed adjacent to each other in a direction intersecting the relative movement direction, wherein an arrangement direction of the ejection openings formed in the first recording element substrate, and an arrangement direction of the ejection openings formed in the second recording element substrate are, when viewed from an upstream side towards a downstream side in the relative movement direction, inclined with respect to the relative movement direction towards a middle area side of the ejection opening rows of the first recording element substrate, and wherein in the relative movement direction of the printed medium, when viewed from the liquid ejection head towards the printed medium, arrangement intervals of the ejection openings in an end portion area on the second recording element substrate side of a first ejection opening row, among the plurality of ejection opening rows of the first recording element substrate, disposed on a most downstream side is larger than arrangement intervals of the ejection openings in an end portion area on the first recording element substrate side of a second ejection opening row, among the plurality of ejection opening rows of the second recording element substrate, disposed on the most upstream side.

16. A recording apparatus comprising:

a liquid ejection head that ejects liquid on a printed medium; and a conveying member that conveys the printed medium to the liquid ejection head, wherein the liquid ejection head includes first and second recording element substrates that include a plurality of ejection opening rows in which ejection openings that eject liquid are arranged in a direction intersecting a relative movement direction of the printed medium, the plurality of ejection opening rows being juxtaposed in the relative movement direction, wherein the first and second recording element substrates are disposed adjacent to each other in a direction intersecting the relative movement direction, wherein a straight line connecting the ejection openings in end portions on a second recording element substrate side of the plurality of ejection opening rows of the first recording element substrate and a straight line connecting the ejection openings in end portions on a first recording element substrate side of the plurality of ejection opening rows of the second recording element substrate are, when viewed from an upstream side towards a downstream side in the relative movement direction, inclined relative to the relative movement direction towards a middle area side of the ejection opening rows of the first recording element substrate, and wherein in the relative movement direction of the printed medium, when viewed from the liquid ejection head towards the printed medium, arrangement intervals of the ejection openings m an end portion area on the second recording element substrate side of a first ejection opening row, among the plurality of ejection opening rows of the first recording element substrate, disposed on a most upstream side is larger than arrangement intervals of the ejection openings in an end portion area on the first recording element substrate side of a second ejection opening row, among the plurality of ejection opening rows of the second recording element substrate, disposed on the most upstream side.

* * * * *